US006343448B1

(12) United States Patent
Lin

(10) Patent No.: US 6,343,448 B1
(45) Date of Patent: Feb. 5, 2002

(54) AUXILIARY FRAME FOR IMPROVING CONVENTIONAL FRAME AND METHOD FOR WORKING THE SAME

(76) Inventor: Chun-Chen Lin, No. 21, Alley 9, Lane 27, Sec. 5, Min Shen E. Rd., Taipei (TW)

( * ) Notice: Subject to any disclaimer, the term of this patent is extended or adjusted under 35 U.S.C. 154(b) by 0 days.

(21) Appl. No.: 09/561,116

(22) Filed: Apr. 28, 2000

(51) Int. Cl.[7] ..... E04C 3/38

(52) U.S. Cl. ..... 52/204.1; 52/213; 52/210; 52/272; 52/656.2; 52/656.1; 49/504

(58) Field of Search ..... 52/204.1, 202, 52/213, 272, 278, 210, 211, 212, 204.2, 656.1, 656.2, 656.7, 656.4, 656.5, 656.6; 49/504

(56) References Cited

U.S. PATENT DOCUMENTS 3,546,815 A * 12/1970 Kimberly ..... 52/656
3,769,773 A * 11/1973 Mochizuki ..... 52/656
3,886,688 A * 6/1975 Ragland ..... 49/504
4,747,248 A * 5/1988 Fahs ..... 52/455
4,974,364 A * 12/1990 Durham, Jr. ..... 49/400
5,584,157 A * 12/1996 Sun ..... 52/656.4
5,603,191 A * 2/1997 Wu ..... 52/204.1
5,724,779 A * 3/1998 Chang et al. ..... 52/239
5,950,391 A * 9/1999 Hagel ..... 52/656.4
6,067,754 A * 5/2000 Bellart ..... 49/453
6,070,375 A * 6/2000 Anderson et al. ..... 52/204.54
6,148,572 A * 11/2000 Ruff ..... 52/204.1
6,148,584 A * 11/2000 Wilson ..... 52/717.01

* cited by examiner

*Primary Examiner*—Carl D. Friedman
*Assistant Examiner*—Phi Dieu Tran A
(74) *Attorney, Agent, or Firm*—Rosenberg, Klein & Lee

(57) ABSTRACT

The auxiliary frame has a plurality of frame bars made of plastic or metallic material. Each of the frame bars has a hollow inside and has a crossed reinforcing rib installed therein. One side of each of the frame bars forms an embowed reinforcing girder to achieve better reinforcing effect. A through hole and a snap groove are disposed at each side of the reinforcing girder. Two of the frame bars are disposed at opposite sides, while another frame bar is disposed at the top ends of the two frame bars. A fixing element is installed between the bottom ends of the two frame bars at two sides. The two ends of the frame bar at top end are screwed with the two frame bars via a plurality of screws vertically penetrating the through holes at the top ends of the two frame bars. The bottom ends of the two frame bars are screwed with the two ends of the fixing element via a plurality of screws vertically penetrating the through holes at the bottom ends of the two frame bars.

3 Claims, 12 Drawing Sheets

AUXILIARY FRAME FOR IMPROVING CONVENTIONAL FRAME AND METHOD FOR WORKING THE SAME

FIELD OF THE INVENTION

The present invention relates to an auxiliary frame for improving a conventional frame and a method for working the same and, more particularly, to an auxiliary frame and a method for working the same, which has good moisture-proof and waterproof effects, and can be maintained more conveniently.

BACKGROUND OF THE INVENTION

Conventional frames such as doorframes are generally made of wood having inferior strength and bad moisture-proof and waterproof effects so that they can easily rot, resulting in much limited usage. Moreover, doorframes made of wood consume much natural wood material. Their fireproof effect is bad. Additionally, after doorframes made of wood has rotted, all wall material and floor material must be discarded, thereby wasting much time, labor, and material. Also, the working environment will be very dirty and result in much inconvenience.

SUMMARY AND OBJECTS OF THE PRESENT INVENTION

The primary object of the present invention is to provide an auxiliary frame for improving a conventional frame, which comprises a plurality of frame bars. The frame bars are made of plastic or metallic material. A fixing element is installed at the bottom end of the frame bars at two sides. The fixing element and the frame bars are connected to form an assembly via a plurality of screws, thereby forming the auxiliary frame. The auxiliary frame can be formed and installed at a predetermined position to achieve superior strength and better moisture-proof and waterproof effects so that it will not easily rot. Moreover, natural wood material can be saved greatly, conforming to the requirement of environment protection. Additionally, the auxiliary frame can help to lacquer a rustic color on the wood material of the frame or dip the wood material of the frame in fireproof solution, thereby forming a fireproof high-class doorframe or window frame.

Another object of the present invention is to provide an auxiliary frame for improving a conventional frame, which can solve several drawbacks of a conventional frame. For a conventional frame made of wood, all wall material and floor material must be discarded after it has rotted, thereby wasting much time, labor, and material. Also, the working environment will be very dirty and result in much inconvenience. For the auxiliary frame of the present invention, it is not necessary to discard wall material and floor material when the frame has rotted. The bottom material still exists. Only peripheral material needs to be replaced so that no additional process is needed. Moreover, color and material can be selected according to individual liking. The user can do it yourself (DIY) at any time. Additionally, the frame will not be blotted or impacted to break so that quality can be kept. Also, there is no doorstop on the floor to block the walk of people.

The various objects and advantages of the present invention will be more readily understood from the following detailed description when read in conjunction with the appended drawings, in which:

DETAILED DESCRIPTION OF PREFERRED EMBODIMENT

Figure 1:
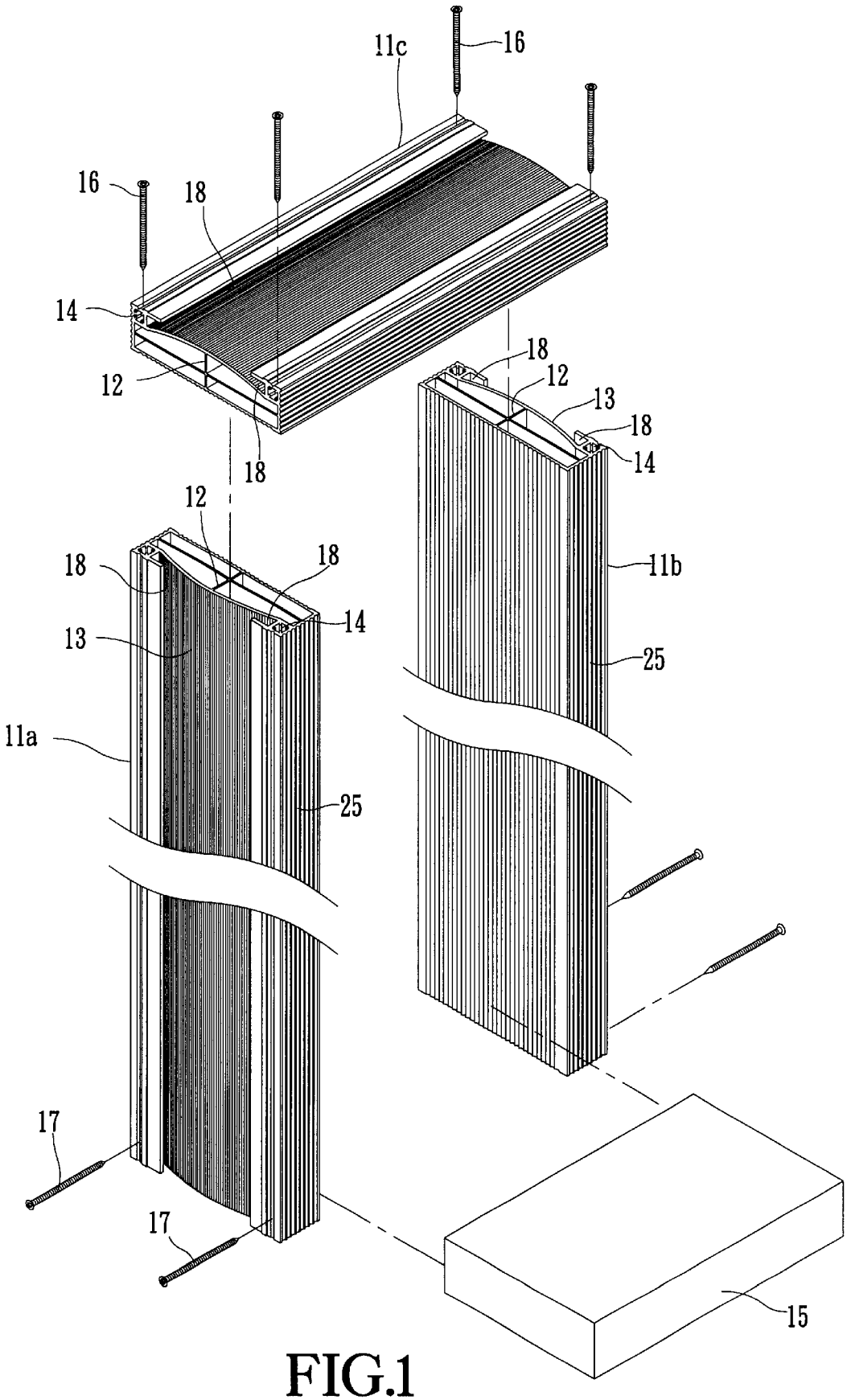
FIG. 1 is an exploded perspective view of an auxiliary frame of the present invention.
Figure 2:
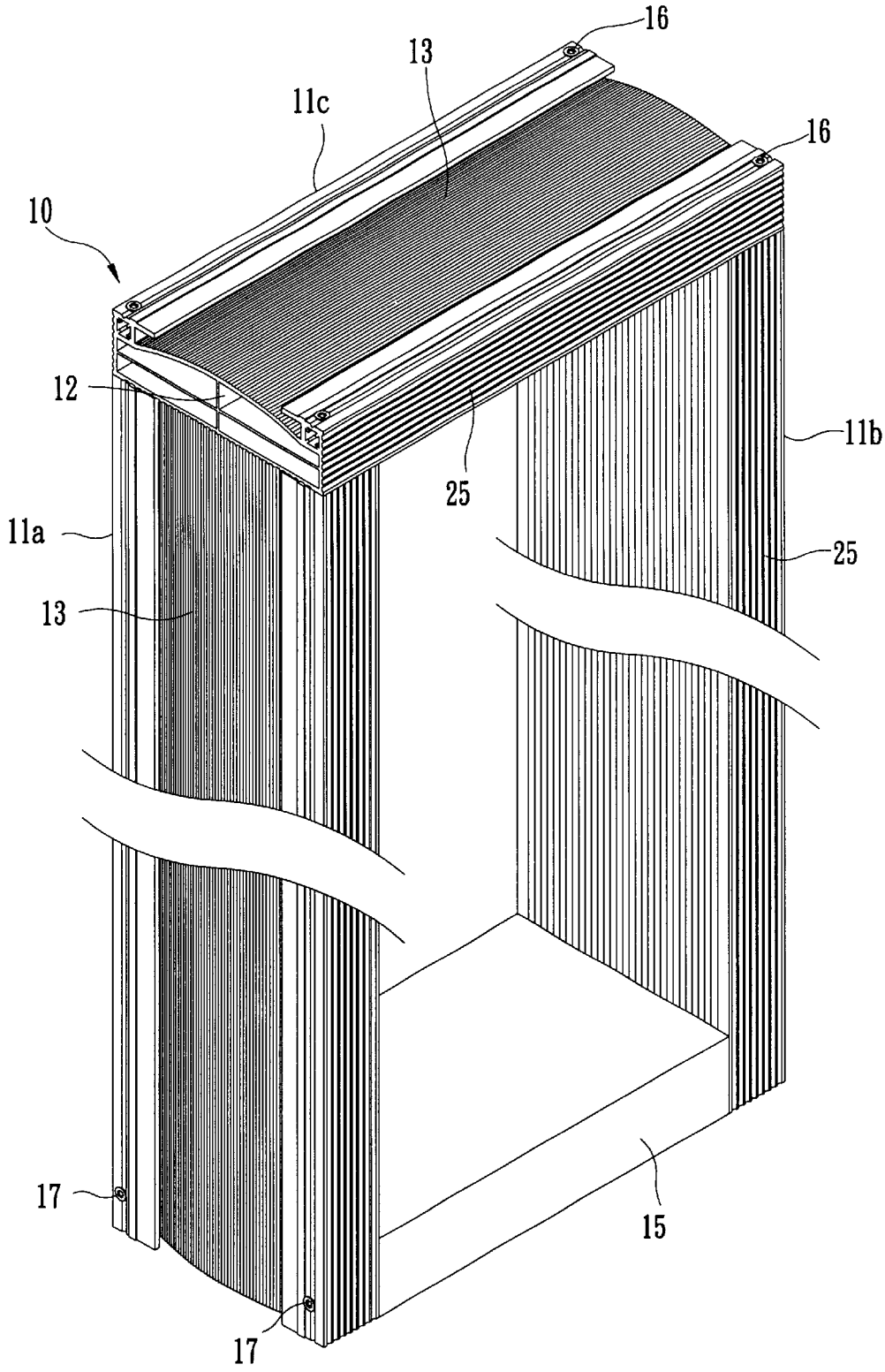
FIG. 2 is a perspective view of an auxiliary frame of the present invention.

As shown in FIGS. 1 and 2, the present invention provides an auxiliary frame for improving a conventional frame. The proposed auxiliary frame 10 comprises three frame bars 11*a*, 11*b*, and 11*c*. The three frame bars 11*a*, 11*b*, and 11*c* are made of plastic or metallic material, each being of a predetermined length. Each of the three frame bars 11*a*, 11*b*, and 11*c* has a hollow inside and has a crossed reinforcing rib 12 installed therein (Please also refer to FIG. 12). One side of each of the three frame bars 11*a*, 11*b*, and 11*c* forms an embowed reinforcing girder 13 to achieve better reinforcing effect. A through hole 14 and a snap groove 18 are disposed at each side of the reinforcing girder 13. The two frame bars 11*a* and 11*b* are disposed at opposite sides, while the frame bar 11*c* is disposed at the top end of the two frame bars 11*a* and 11*b*, thereby forming the reversely U-shaped auxiliary frame 10. A fixing element 15 is installed between the bottom end of the two frame bars 11*a* and 11*b*. The two ends of the frame bar 11*c* are screwed with the two frame bars 11*a* and 11*b* via a plurality of screws 16 vertically penetrating the through holes 14 at the top ends of the two frame bars 11*a* and 11*b*. The bottom ends of the two frame bars 11*a* and 11*b* are screwed with the two ends of the fixing element 15 via a plurality of screws 17 vertically penetrating the through holes 14 at the bottom ends of the two frame bars 11*a* and 11*b*. The auxiliary frame 10 thus assembled can be transported to the working place for working.

Figure 3:
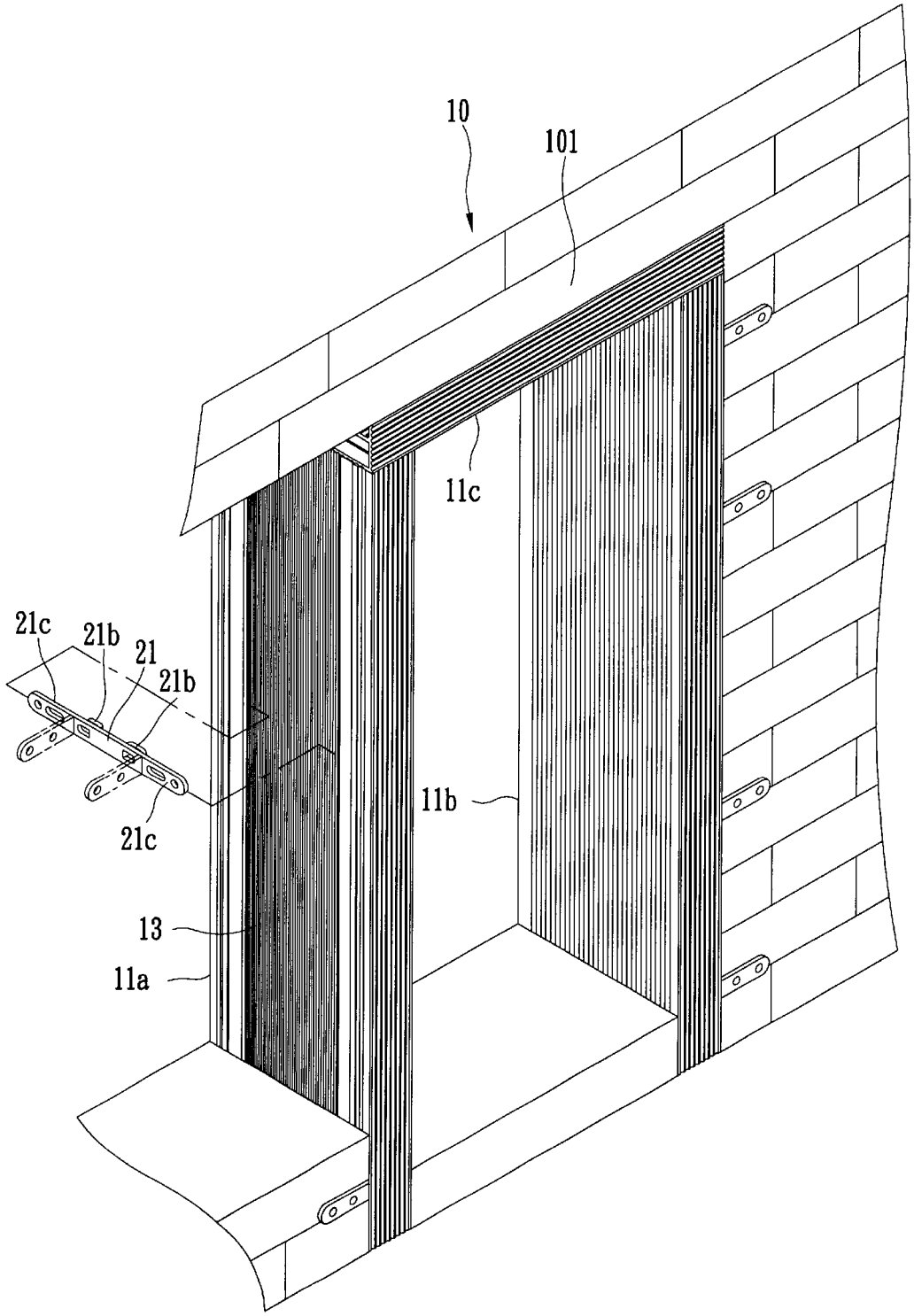
FIG. 3 is a perspective view of an auxiliary frame of the present invention when worked.

As shown in FIG. 3, the auxiliary frame 10 can be installed through the help of a fixing component 21 after the bricklaying and solidification of the cement are finished. Each side of the fixing component 21 has a fixing claw end 21*b* to be fixed in the snap groove 18 so that the fixing component 21 can be fixedly mounted in the frame bar 11*b*. The fixing component 21 also extends to form two fixing parts 21*c*. The two fixing parts 21*c* can be bent along the wall 20 to stick to the wall 20 so as to be fixed on the wall 20 via steel nails (not shown).

Figure 4:
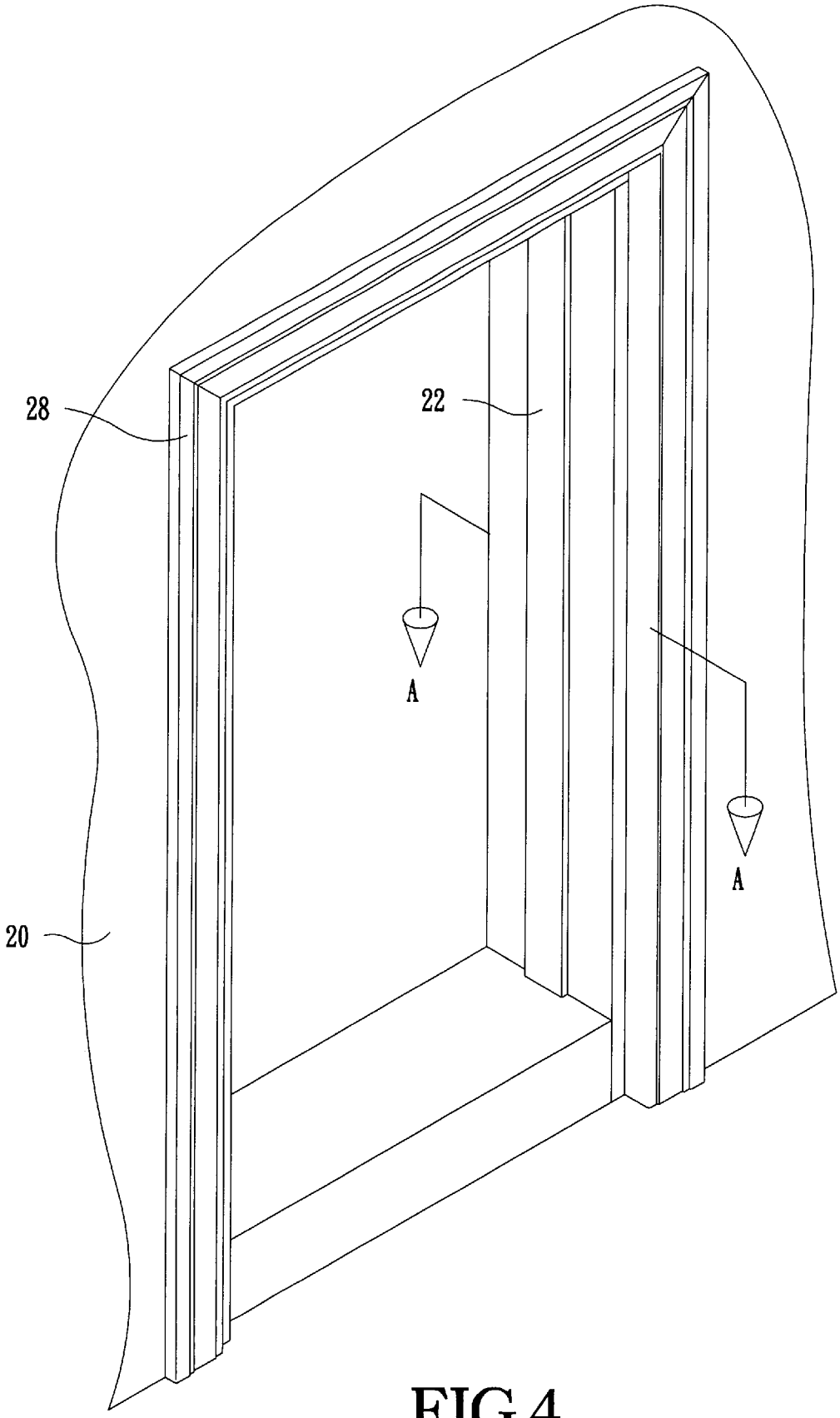
FIG. 4 is a perspective view of an auxiliary frame of the present invention after worked and assembled with a knocked-down doorframe.
Figure 5:
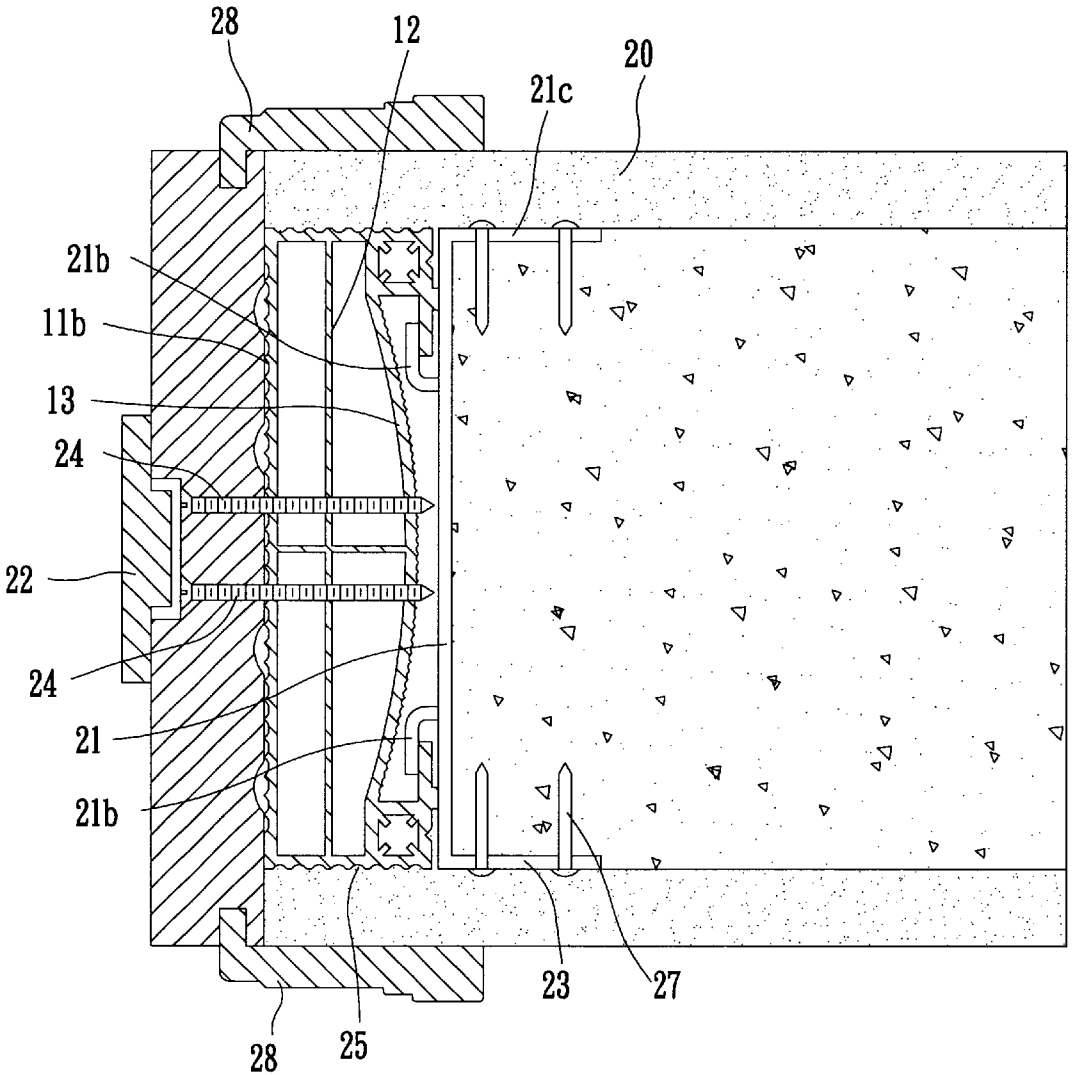
FIG. 5 is a cross-sectional view of FIG. 4 along line A—A.
Figure 6:
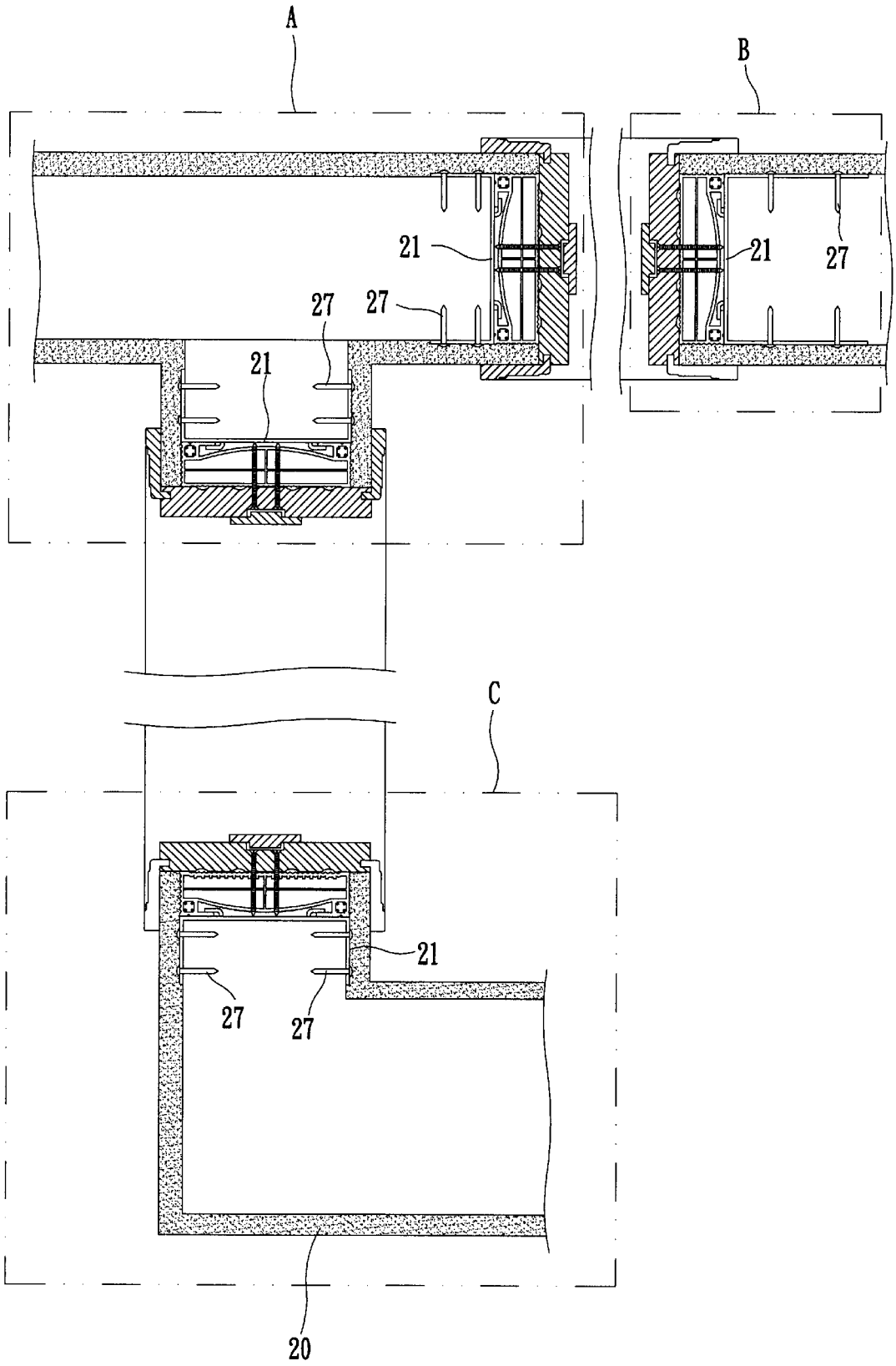
FIG. 6 is a top cross-sectional view of an auxiliary frame according to another embodiment of the present invention.
Figure 7:
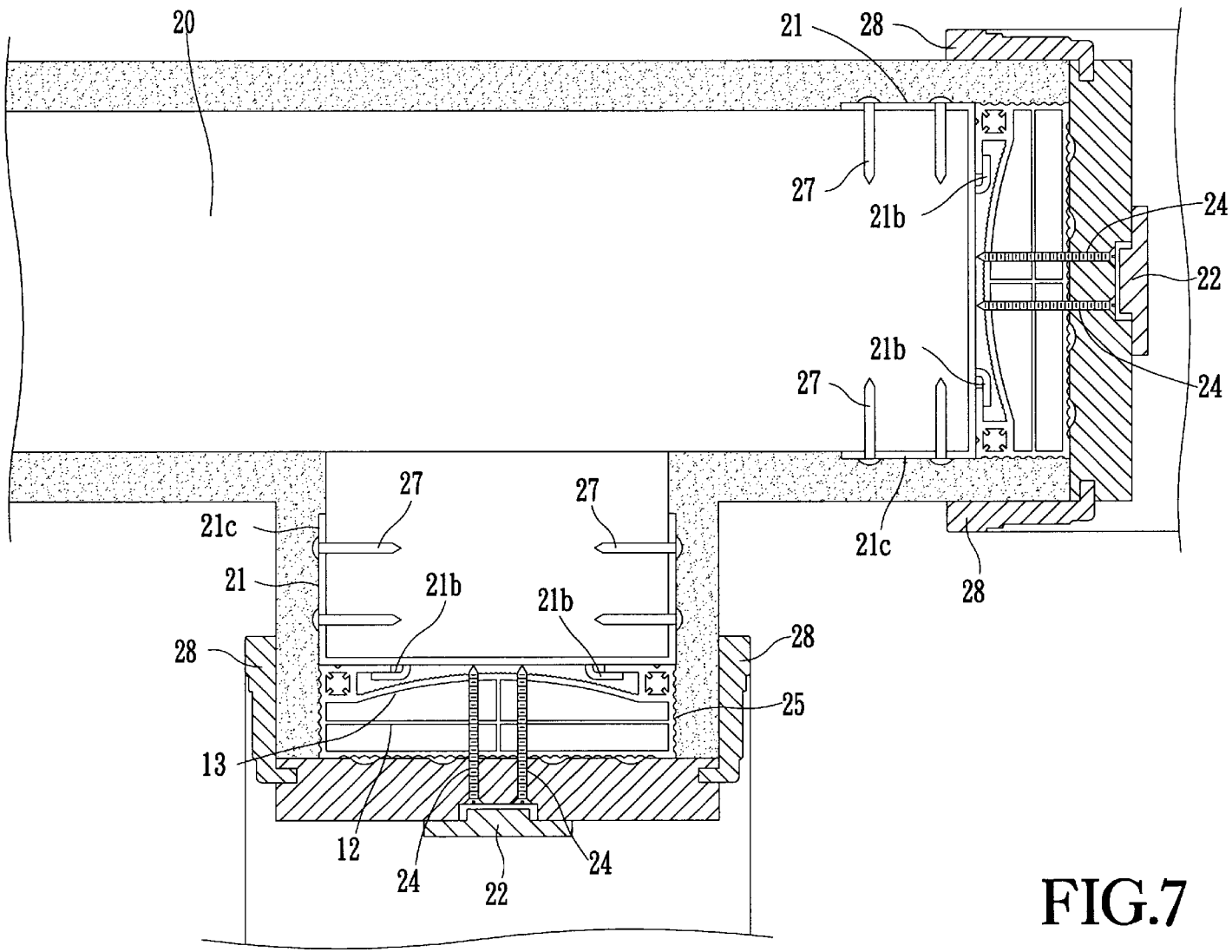
FIG. 7 is a locally enlarged view of region A in FIG. 6.
Figure 8:
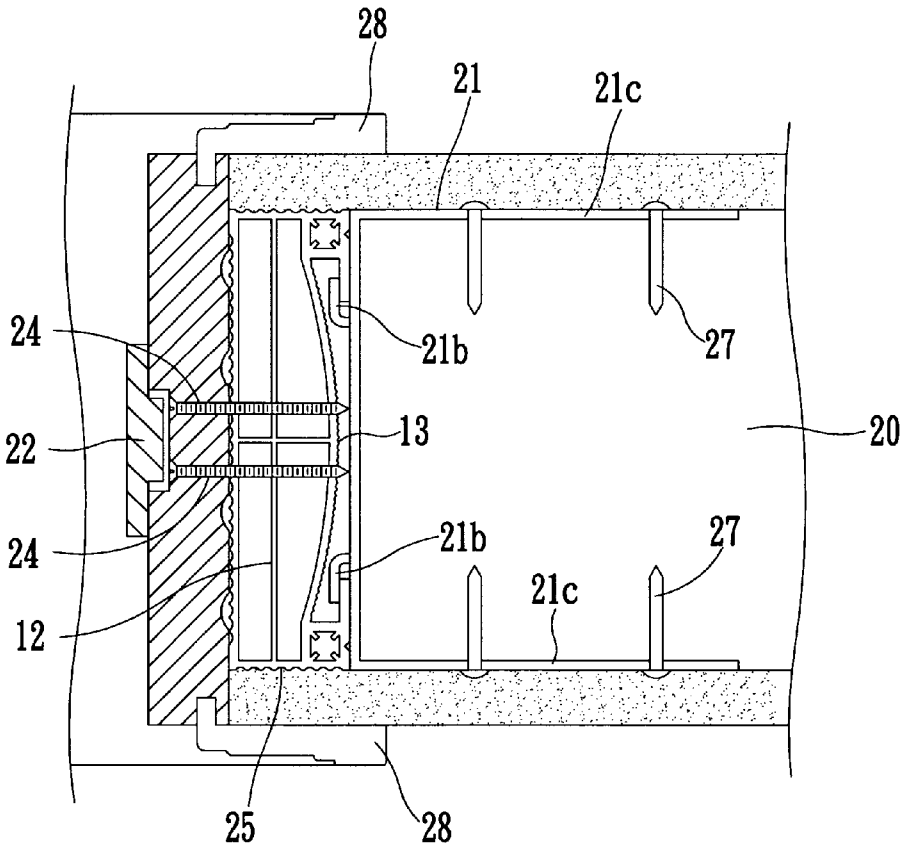
FIG. 8 is a locally enlarged view of region B in FIG. 6.
Figure 9:
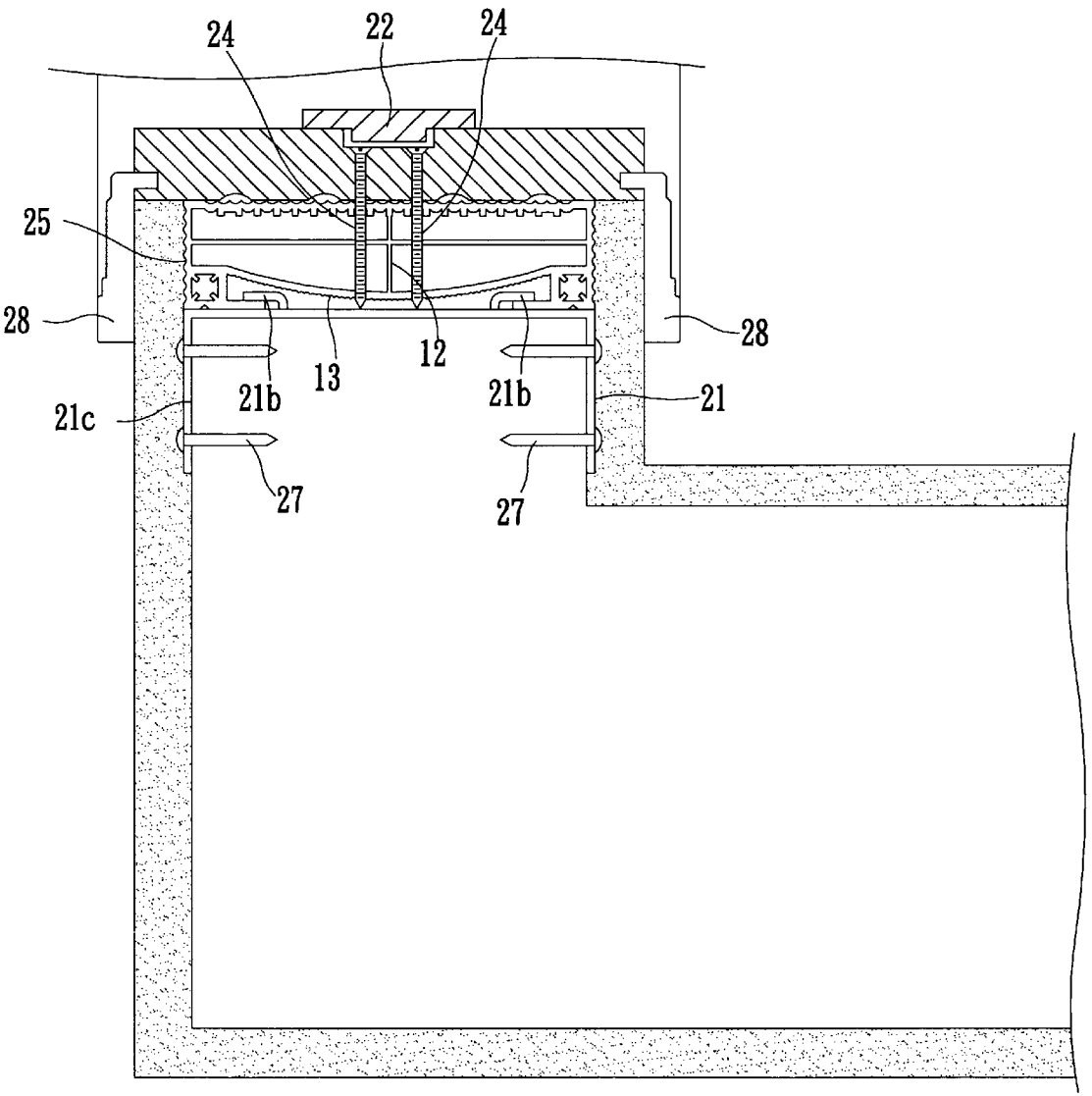
FIG. 9 is a locally enlarged view of region C in FIG. 6.
Figure 10:
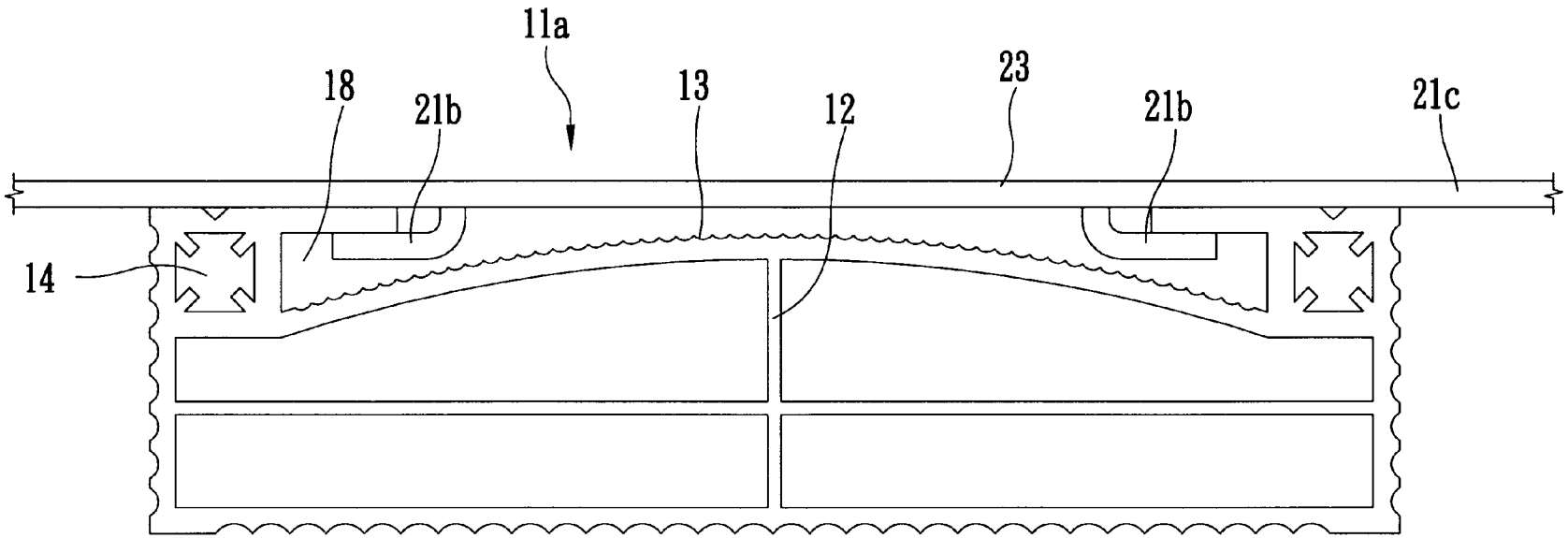
FIG. 10 is an ichnograph of frame bars of an auxiliary frame of the present invention.

As shown in FIGS. 4 and 5, after the working of the auxiliary frame 10 of the present invention, a knocked-down doorframe 22 can be installed. The doorframe 22 is made of wood that can give off aroma so as to achieve mothproof and deodorant effects. A predetermined gap is reserved in the inside of the doorframe 22 so as to facilitate the sizing of glue and to form a moving space after the installation of the door leaf. The doorframe 22 is then fixed after the door leaf is closed.

As shown in FIG. 5, if the wall 20 of a dividing wall uses white bricks or perforated bricks, because C-shaped steels 23 are prefabricated at the edge of while bricks or perforated bricks to be fixedly screwed via screws 27, the fixing component 21 can be saved.

When the wall 20 is whitewashed, cement can be smeared on a corrugated surface 25 at two sides of the auxiliary frame 10. The smeared cement can thus be fixedly attached to the two sides of the auxiliary frame 10.

As shown in FIGS. 6 to 9, various kinds of the fixing components 21 are provided. The fixing component 21 can be bent along the wall 20 to be fixed on the wall 20 via steel nails 27. The fixing component 21 can use the fixing parts 21*c* extending therefrom to stick to the wall 20 so that there is a required gap between the frame bars and the wall 20. The frame bars will thus protrude from the wall 20 a required length to facilitate the assembly of the knocked-down doorframe 22 without the need of cutting an edge bar 28 narrower.

The working method of the auxiliary frame of the present invention for improving a conventional frame comprises the following steps.

(1). Three frame bars made of plastic or metallic material are provided. Two of the three frame bars are disposed at opposite sides, and the third frame bar is disposed at the top ends of the two frame bars. A fixing element is installed between the bottom ends of the two frame bars at two sides. The two ends of the frame bar at the top end are screwed with the two frame bars at two sides via a plurality of screws vertically penetrating the through holes at the top ends of the two frame bars. The bottom ends of the two frame bars at two sides are screwed with the two ends of the fixing element via a plurality of screws vertically penetrating the through holes at the bottom ends of the two frame bars. The auxiliary frame thus assembled can be transported to the working place for working.

(2). When worked, the auxiliary frame is erected at a predetermined position. A predetermined number of fixing components are joined with the auxiliary frame. The auxiliary frame is installed after the bricklaying and solidification of cement are finished. The fixing parts of the fixing components are then bent along the wall to stick to the wall so as to be fixed on the wall via steel nails.

After the working of the auxiliary frame of the present invention, a knocked-down doorframe can be installed. If the wall of a dividing wall uses white bricks or perforated bricks, because C-shaped steels are prefabricated at the edge of while bricks or perforated bricks to be screwed via screws, the fixing component can be saved.

Figure 11:
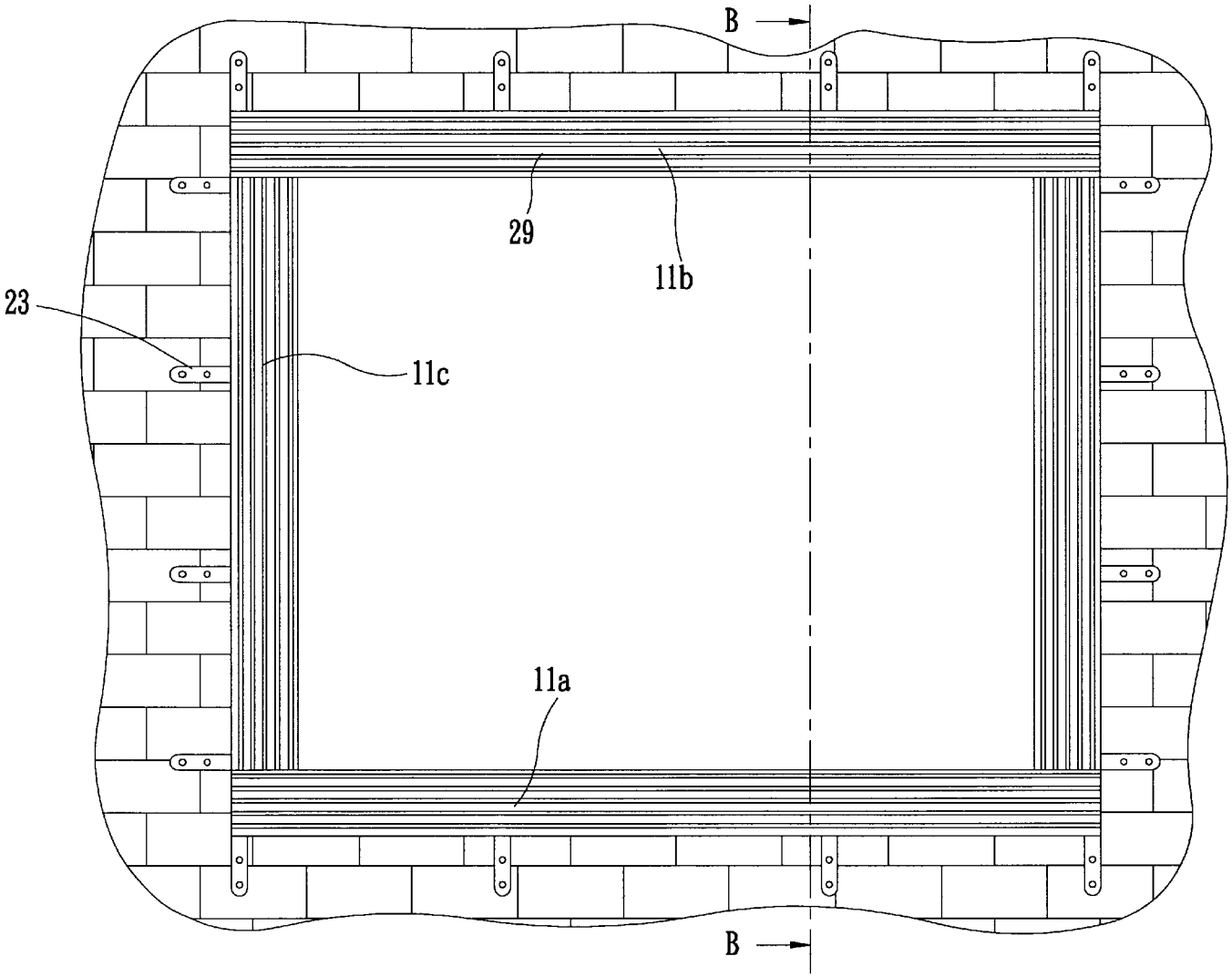
FIG. 11 is an ichnograph of an auxiliary frame according to another embodiment of the present invention.
Figure 12:
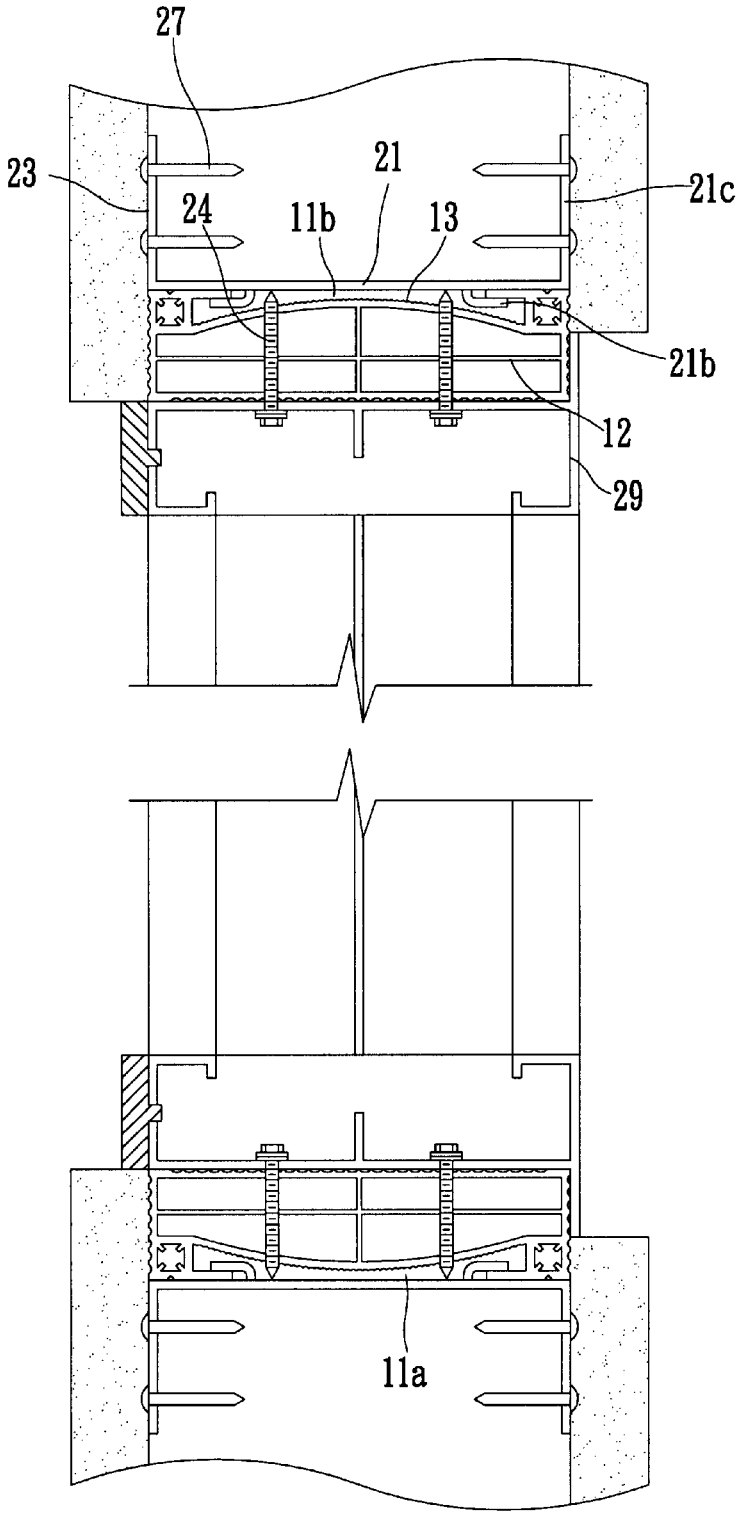
FIG. 12 is a cross-sectional view of FIG. 11 along line B—B.

Additionally, as shown in FIGS. 11 and 12, after the working of the auxiliary frame 10 of the present invention, a window frame 29 can then be installed.

The auxiliary frame 10 of the present invention comprises the frame bars 11*a*, 11*b*, and 11*c* made of plastic or metallic material. The auxiliary frame 10 can be installed at a predetermined position to achieve superior strength and better moisture-proof and waterproof effects so that it will not easily rot. Moreover, natural wood material can be saved greatly, conforming to the requirement of environment protection. Additionally, the auxiliary frame 10 can help to lacquer a rustic color on the wood material of the frame or dip the wood material of the frame in fireproof solution, thereby forming a fireproof high-class doorframe or window frame. For the auxiliary frame of the present invention, it is not necessary to discard wall material and floor material when the frame has rotted. The bottom material still exists. Only peripheral material needs to be replaced so that no additional process is needed. Moreover, color and material can be selected according to individual liking. The user can DIY at any time. Additionally, the frame will not be blotted or impacted to break so that quality can be kept. Also, there is no doorstop on the floor to block the walk of people.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An auxiliary frame for improving a conventional frame comprising a plurality of frame bars made of plastic or metallic material, each of said frame bars having a hollow inside and having a crossed reinforcing rib installed therein, one side of each of said frame bars forming an embowed reinforcing girder to achieve better reinforcing effect, a through hole and a snap groove being disposed at each side of said reinforcing girder, two of said frame bars being disposed at opposite sides, while another said frame bar being disposed at the top ends of said two frame bars, a fixing element being installed between the bottom ends of said two frame bars at two sides, the two ends of said frame bar at top end being screwed with said two frame bars via a plurality of screws vertically penetrating said through holes at the top ends of said two frame bars, the bottom ends of said two frame bars being screwed with the two ends of said fixing element via a plurality of screws vertically penetrating said through holes at the bottom ends of said two frame bars, whereby said auxiliary frame is assembled.

2. The auxiliary frame of claim 1, wherein said auxiliary frame can be erected at a predetermined position and a predetermined number of fixing components are joined with said auxiliary frame, said auxiliary frame being installed after the bricklaying and solidification of cement are finished, each end of said fixing component having a fixing claw end to be fixed in said snap groove so that said fixing component can be fixedly mounted in said frame bars, said fixing component extending to form fixing parts, said fixing parts being bent along a wall to stick to the wall so as to be fixed on the wall via steel nails.

3. The auxiliary frame of claim 1, wherein said auxiliary frame is assembled with a knocked-down doorframe or window frame.

* * * * *